US007336233B2

(12) United States Patent
Thudor et al.

(10) Patent No.: US 7,336,233 B2
(45) Date of Patent: Feb. 26, 2008

(54) RADIATION DIVERSITY ANTENNAS

(75) Inventors: Franck Thudor, Rennes (FR); Françoise Le Bolzer, Rennes (FR); Bernard Denis, Saint Senoux (FR)

(73) Assignee: Thomson Licensing, Boulogne-Billancourt (FR)

( * ) Notice: Subject to any disclaimer, the term of this patent is extended or adjusted under 35 U.S.C. 154(b) by 456 days.

(21) Appl. No.: 10/791,978

(22) Filed: Mar. 3, 2004

(65) Prior Publication Data

US 2005/0237252 A1 Oct. 27, 2005

(30) Foreign Application Priority Data

Mar. 7, 2003 (FR) ..... 03 02842

(51) Int. Cl.
*H01Q 13/10* (2006.01)

(52) U.S. Cl. ..... 343/767

(58) Field of Classification Search ..... 343/767, 343/700 MS, 795, 768, 770, 876
See application file for complete search history.

(56) References Cited

U.S. PATENT DOCUMENTS

| | | | | |
|---|---|---|---|---|
| 3,604,012 | A | 9/1971 | Lindley | 343/768 |
| 6,188,360 | B1 | 2/2001 | Kato et al. | 343/700 |
| 6,344,829 | B1 * | 2/2002 | Lee | 343/753 |
| 6,531,984 | B1 * | 3/2003 | Johannisson et al. | 343/700 MS |
| 6,670,921 | B2 * | 12/2003 | Sievenpiper et al. | 343/700 MS |
| 6,864,848 | B2 * | 3/2005 | Sievenpiper | 343/767 |
| 6,885,344 | B2 * | 4/2005 | Mohamadi | 343/700 MS |

FOREIGN PATENT DOCUMENTS

SU 1675980 A1 9/1991

OTHER PUBLICATIONS

D. T. Shahani et al., "Radiation Characteristics of Printed Slot Antenna with a Switchable Parasitic Slot," Int. Conf. on Antennas and Propagation, Nov. 28-30, 1978, pp. 435-437, XP001154972.
A. T. Kolsrud et al., "Electronically Switchable Slot Antenna Fed by Microstrip Line," IEEE, Atlanta, GA, Jun. 21-26, 1998, pp. 1180-1183, XP010292351.
D. Peroulis et al., "A Planar VHF Reconfigurable Slot Antenna," IEEE Boston, MA, Jul. 8-13, 2001, pp. 154-157, XP001072179.

* cited by examiner

*Primary Examiner*—Huedung Mancuso
(74) *Attorney, Agent, or Firm*—Joseph J. Laks; Robert D. Shedd; Brian J. Cromarty

(57) ABSTRACT

The present invention relates to a radiation diversity antenna consisting of radiating elements of the slot-line type coupled electromagnetically to a feed line, in which the radiating elements have a tree structure, each radiating element having a length equal to kλs/2 where k is an identical or different integer from one element to the next and λs is the guided wavelength in the slot-line constituting the radiating element with at least one radiating element comprising a switching means positioned in the slot-line constituting the said radiating element in such a way as to control the coupling between the said radiating element and the feed line as a function of a command. The invention applies chiefly to wireless transmissions.

8 Claims, 9 Drawing Sheets

RADIATION DIVERSITY ANTENNAS

This application claims the benefit under 35 U.S.C. § 119 of French application number 0302842, filed Mar. 7, 2003.

FIELD OF THE INVENTION

The present invention relates to the field of radiation diversity antennas. This type of antenna can be used in the field of wireless transmissions, in particular within the context of transmissions in an enclosed or semi-enclosed environment such as domestic environments, gymnasiums, television studios, auditorium or the like.

BACKGROUND OF THE INVENTION

Within the context of transmissions inside enclosed or semi-enclosed environments, the electromagnetic waves undergo fading phenomena related to the multiple paths resulting from numerous reflections of the signal off the walls and off the furniture or other surfaces envisaged in the environment. In order to combat these fading phenomena, a well known technique is the use of space diversity.

In a known manner, this technique consists in using for example a pair of antennas with wide spatial coverage such as two antennas of slot type or of "patch" type that are linked by feed lines to a switch, the choice of antenna being made as a function of the level of the signal received. The use of this type of diversity requires a minimum spacing between the radiating elements so as to ensure sufficient decorrelation of the channel response seen through each radiating element. Therefore, this solution has the drawback of being, among other things, bulky.

To remedy this bulkiness problem, the use of antennas exhibiting radiation diversity has been proposed. This radiation diversity is obtained by switching between radiating elements placed in proximity to one another. This solution makes it possible to reduce the bulkiness of the antenna while ensuring sufficient diversity.

BRIEF SUMMARY OF THE INVENTION

The present invention therefore relates to a novel type of radiation diversity antennas.

According to the invention, the radiation diversity antenna consisting of a radiating element of the slot-line type coupled electromagnetically to a feed line, is characterized in that the radiating element consists of arms in a tree structure, each arm having a length equal to $k\lambda s/2$ where k is an identical or different integer from one arm to the next and $\lambda s$ is the guided wavelength in the slot-line constituting the arm and in that at least one of the arms comprises a switching means positioned in the slot-line constituting the said arm in such a way as to control the coupling between the said arm and the feed line as a function of a command.

The antenna described above can operate in various modes exhibiting radiation patterns that are complementary as a function of the state of the switching means. With this tree structure, a large number of operating modes is accessible.

According to a preferred embodiment of the invention, each arm comprises a switching means. Moreover, the switching means is positioned in an open-circuit zone of the slot, this switching means possibly consisting of a diode, a transistor arranged as a diode or an MEMS (Micro Electro Mechanical System).

According to a further characteristic of the present invention, the length of each arm is delimited by an insert positioned in a short-circuit plane, the insert being placed at the level of the junctions between arms.

Moreover, the tree structure may exhibit an H or Y shape or one which is an association of these shapes.

According to another characteristic of the present invention, the antenna is produced by microstrip technology or by coplanar technology.

BRIEF DESCRIPTION OF THE DRAWINGS

Other characteristics and advantages of the present invention will become apparent on reading the description of various embodiments, this description being given with reference to the appended drawings in which.

DESCRIPTION OF PREFERRED EMBODIMENTS

Figure 1:
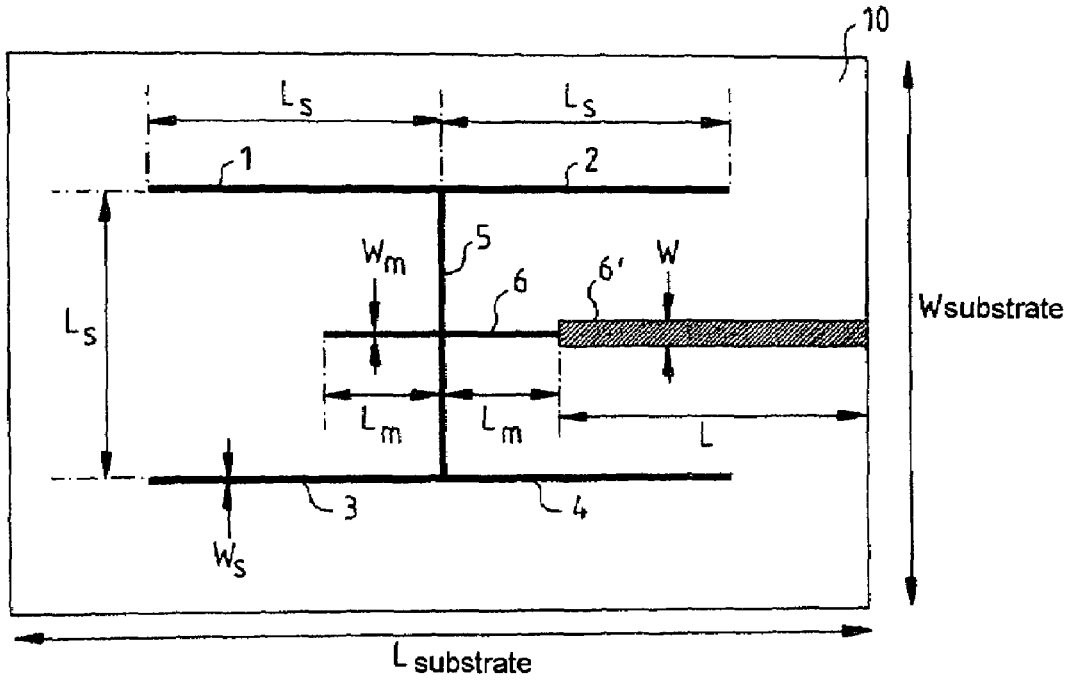
FIG. 1 represents a diagrammatic view of a radiation diversity antenna exhibiting a tree structure.

A preferred embodiment of the present invention will firstly be described with reference to FIGS. 1 to 7. In this case, as represented in FIG. 1, the radiation diversity antenna consists chiefly of a radiating element of the slot-line type formed of arms in an H structure. This structure is produced in a known manner by microstrip technology on a substrate 1 whose faces have been metallized. More specifically, this structure comprises five radiating arms 1, 2, 3, 4, 5 each consisting of a slot-line etched on the upper face on the substrate 10 and arranged in an H.

Figure 2:
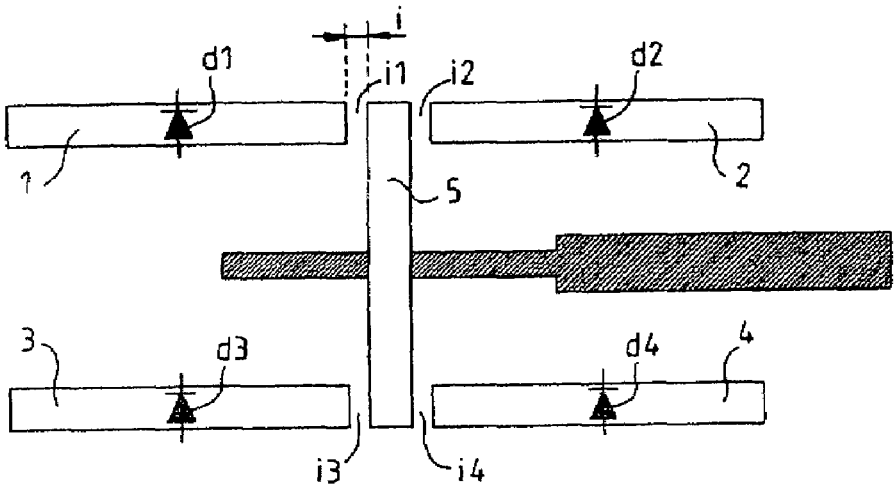
FIG. 2 is a diagrammatic view from above of the structure represented in FIG. 1 furnished with switching means, in accordance with the present invention.

Moreover, as represented in FIG. 1, the slot-lines are fed by electromagnetic coupling according to the theory described by Knorr, via a single feed line 6 produced on the lower face of the substrate 10. Therefore, as represented in FIG. 2, the feed line 6 is perpendicular to the slot 5 and extends over a distance Lm of the order of $k\lambda m/4$ where $\lambda m$ is the guided wavelength in the feed line and $\lambda m=\lambda 0/\sqrt{\epsilon reff}$ (with $\lambda 0$ the wavelength in vacuo and $\epsilon reff$ the relative permittivity of the line), k being an odd integer. The feed line is extended beyond a distance Lm by a line 6' of length L and of width W which is greater than the width of the line 6 allowing a 50 Ohm connection. The five radiating arms 1, 2, 3, 4, 5 consist of slot-lines of length Ls in which $Ls=k\lambda s/2$ with $\lambda s=\lambda 0/\sqrt{\epsilon r1eff}$, $\epsilon r1eff$ being the relative permittivity of the slot and k being an integer which may be the same for each arm or different according to the desired tree.

To obtain an antenna with an H structure as represented in FIGS. 1 and 2, making it possible to obtain radiation diversity, switching means are positioned in the slot-line constituting the arm in such a way as to control the electromagnetic coupling between the said arm and the feed line. More specifically, diodes d1, d2, d3, d4, are positioned in each slot-line 1, 2, 3, 4 in an open-circuit plane of the slot-line. As the slot-lines exhibit a length $Ls=k\lambda s/2$, more particularly $\lambda s/2$, the diodes are placed in the middle of each slot-line 1, 2, 3, 4. In the embodiment represented, a diode is placed in each of the slots. However, it is obvious to the person skilled in the art that a radiation diversity antenna would already be obtained with a single diode placed in one of the slots.

Moreover, according to another characteristic of the invention, metal inserts are placed in short-circuit zones of the arms of slot-line type, namely at the level of the junctions of the arms, as is represented in FIG. 2. The inserts being located in a short-circuit zone therefore do not modify the operation of the structure when none of the diodes d1, d2, d3 or d4 is active but they impose a zero-current apportionment in the slot-line when the corresponding diode is active.

Moreover, as will be explained in greater detail hereinbelow, when one of the diodes d1, d2, d3 or d4 is active, it imposes a short-circuit condition in the open-circuit zone of the corresponding arm of slot-line type, thereby preventing the radiation of an electromagnetic field in this element.

The manner of operation of the structure represented in FIG. 2 as a function of the state of the diodes d1, d2, d3, d4 will now be explained in greater detail with reference to FIGS. 1 to 7.

Figure 3A:
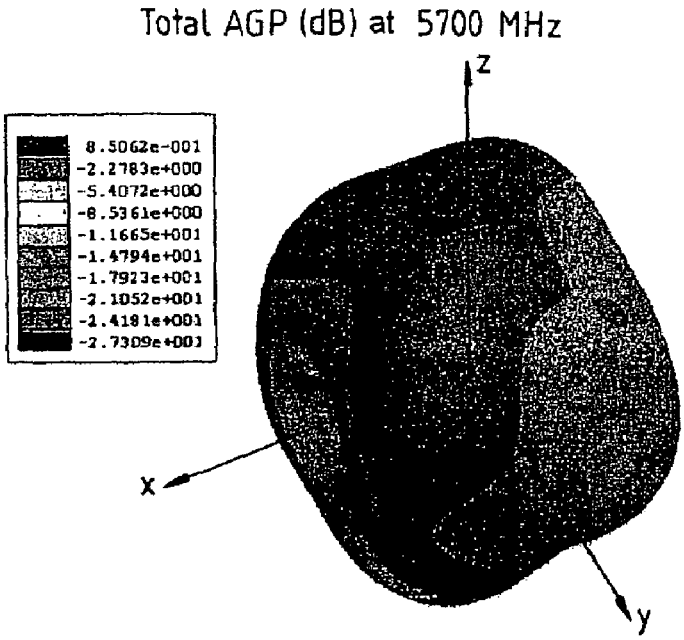
FIGS. 3*a* and 3*b* respectively represent a 3D and 2D radiation pattern of the antenna structure according to FIG. 1.
Figure 3B:
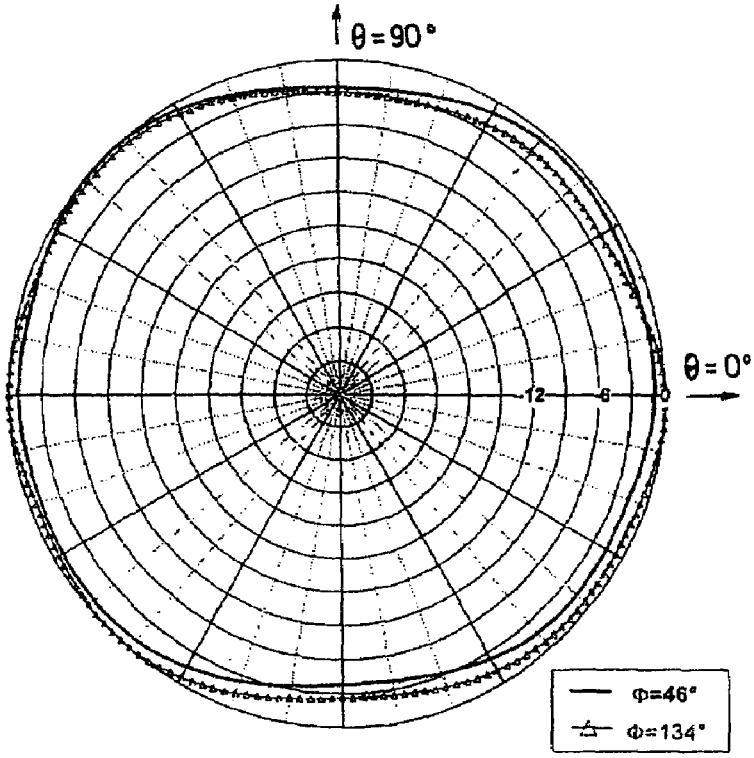

1) None of the diodes d1, d2, d3, d4 is active: when the H structure is energized, a radiation pattern is obtained such as represented in FIG. 3*a* for a 3D representation or FIG. 3*b* for a 2D representation. In this case, according to the 3D representation of FIG. 3*a*, a quasi-omnidirectional radiation pattern is obtained with, in particular, two omnidirectional planes, one at $\phi=45°$ and the other at $\phi=135°$. This is confirmed by the 2D pattern of FIG. 3*b* representing a section through the planes $\phi=46°$ and $\phi=134°$. Moreover, the curve of FIG. 3*b* shows a maximum oscillation of the 3 db gain for the sectional planes.

Figure 4A:
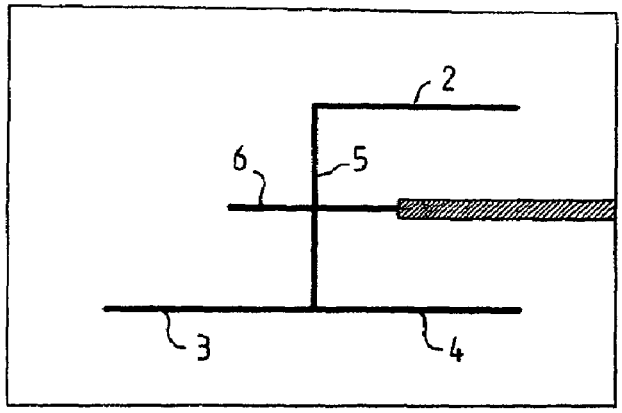
FIGS. 4*a*, 4*b* and 4*c* respectively represent the antenna of FIG. 2 when a diode is active, respectively, according to a theoretical model FIG. 4*a*, the simulated model FIG. 4*b* and the 3D radiation pattern FIG. 4*c*.
Figure 4B:
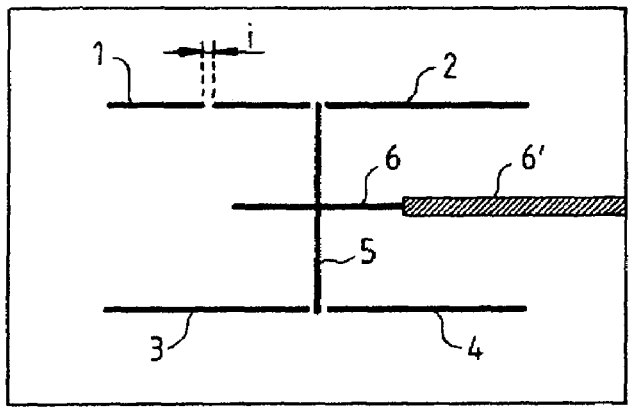
Figure 4C:
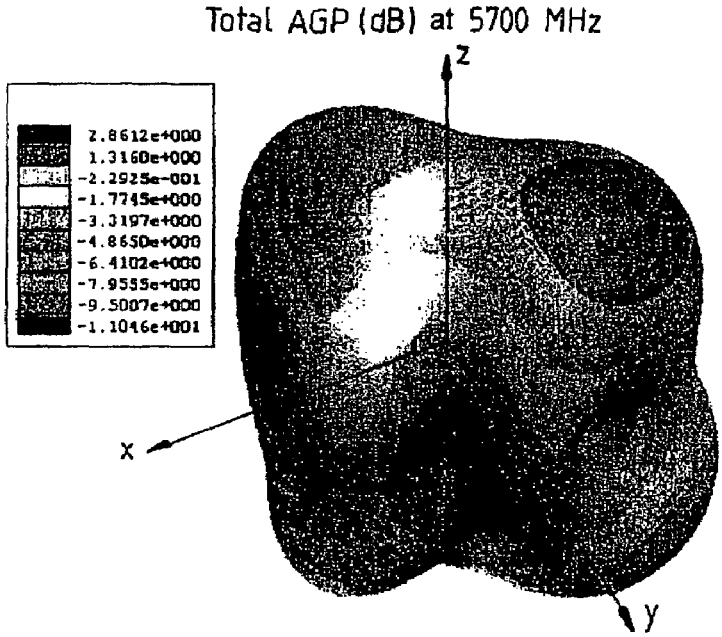

2) Just one of the diodes is active, out of the four diodes d1, d2, d3, d4. Four modes of operation can therefore be defined. In this case, for each of these modes, the radiation pattern will possess a quasi-omnidirectional sectional plane. If, as represented in FIGS. 4*a* and 4*b*, the diode d1 positioned in the slot-line 1 is active, the plane $\phi=135°$ is a quasi-omnidirectional sectional plane, as represented in the 3D radiation pattern of FIG. 4*c*.

In Table 1 below will be given the direction of the quasi-omnidirectional sectional plane in the case where each of the diodes d1, d2, d3 or d4 is active in turn as well as the variation in the gain in this plane.

TABLE 1

| Active diode | Plane | Variation in gain in the plane |
|---|---|---|
| 1 | 135° | 6 dB |
| 2 | 45° | 7 dB |
| 3 | 315° | 6 dB |
| 4 | 225° | 6 dB |

Figures 5A, 5B:
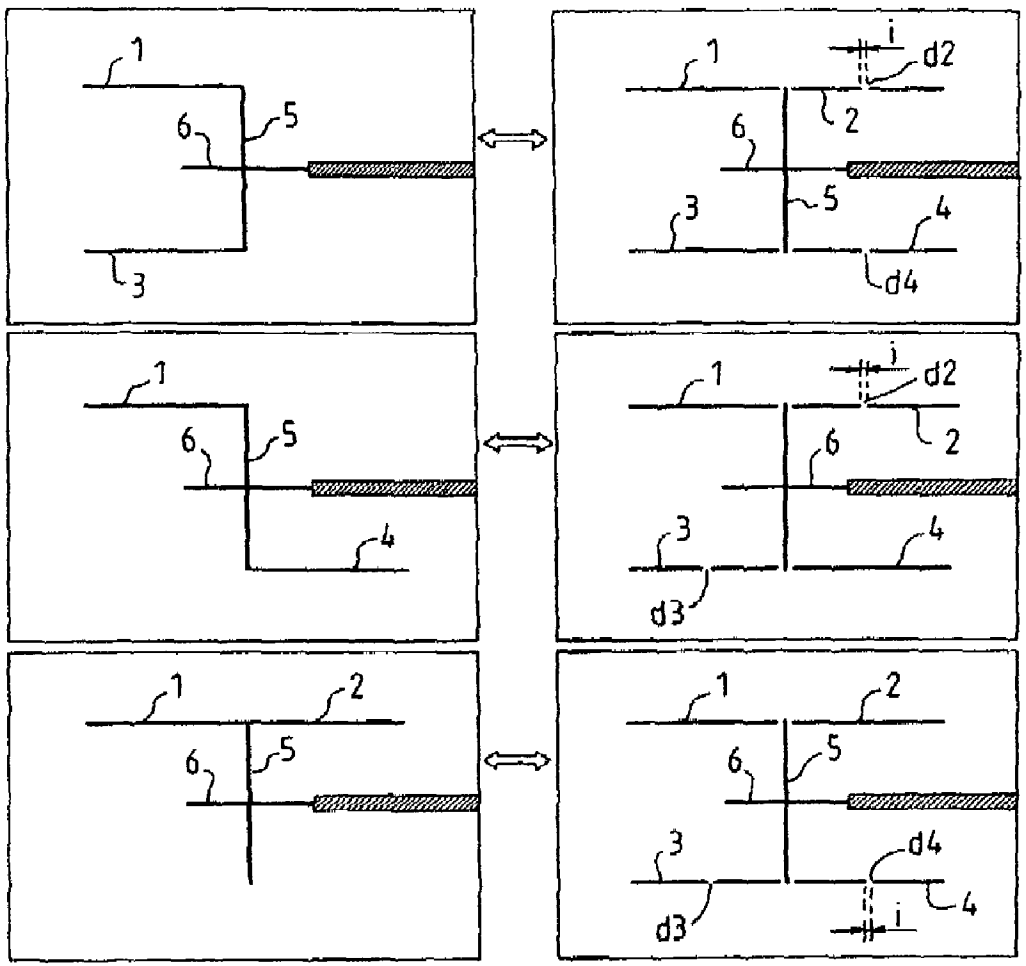
FIGS. 5*a*, 5*b* and 5*c* are identical to FIGS. 4*a*, 4*b* and 4*c* respectively when the diodes 2 and 4 are active, then when the diodes 2 and 3 are active and when the diodes 3 and 4 are active.
Figure 5C:
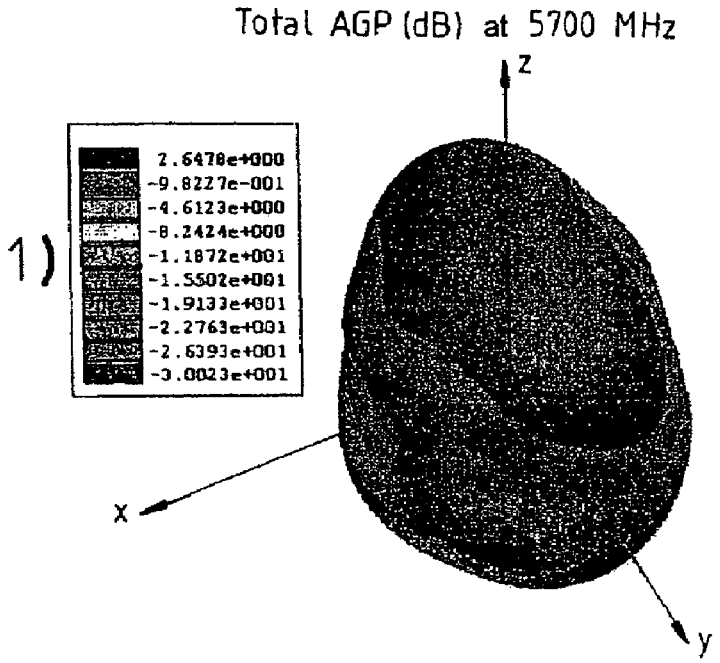
Figure 5C:
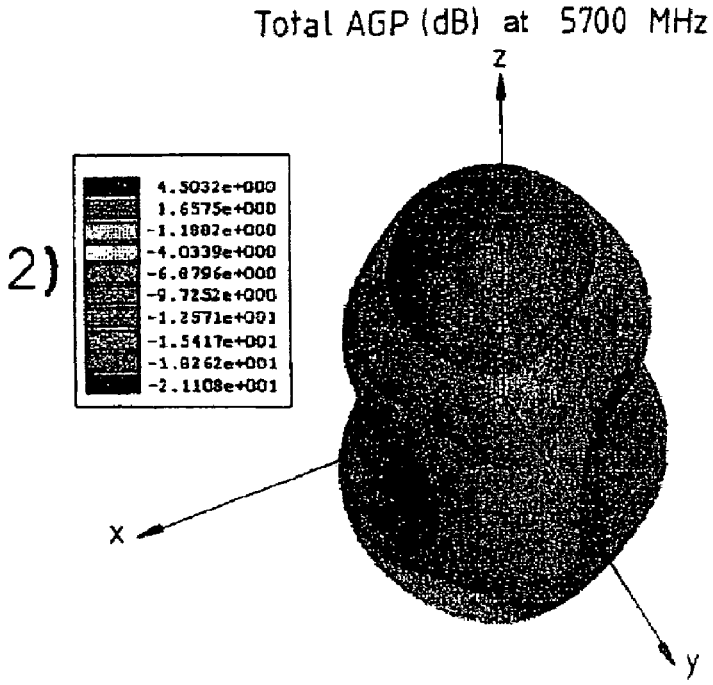
Figure 5C:
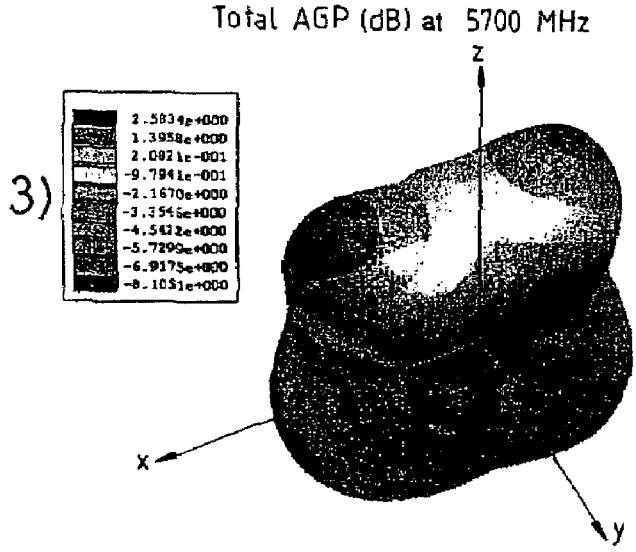

3) Two diodes are active: the case where the diodes are active pairwise in the structure of FIG. 2 will now be described with reference to FIGS. 5*a*, 5*b* and 5*c*. In this case it is possible to define modes of operation exhibiting a U, Z, or T structure as well as their dual modes. The structures have been simulated in the manner represented in FIG. 5*b* and the radiation patterns obtained have shown that each of the modes exhibited a plane for which the radiation pattern is quasi-omnidirectional. Thus, when the diodes d2 and d4 are active, a U structure with a quasi-omnidirectional radiation pattern for a 90° sectional plane (FIG. 5*c*1) is obtained, as represented in FIG. 5*a*1. When the diodes d2 and d3 are active, a Z structure is obtained, as represented in FIG. 5*a*. In this case, the quasi-omnidirectional radiation pattern is obtained for a plane such that $\phi=67.5°$ (FIG. 5*c*2). For the dual Z slot obtained when the diodes d1 and d4 are active, the quasi-omnidirectional plane is obtained for $\phi=112.5°$. When the diodes d3 and d4 are active, a T structure is obtained, as represented in FIG. 5*a*3. In this case, the quasi-omnidirectional radiation pattern is obtained for a sectional plane such that $\phi=0°$ (FIG. 5*c*3).

All the results are given in Table 2.

TABLE 2

| Active diodes | Mode of operation | Plane(s) | Variation in gain in the plane(s) |
|---|---|---|---|
| 2 and 4 (resp. 1 and 3) | U (resp. dual) slot | 90° | 6 dB |
| 2 and 3 | Z slot | 67.5° | 6 dB |
| 1 and 4 | dual Z slot | 112.5° | 6 dB |
| 3 and 4 (resp. 1 and 2) | T (resp. dual) slot | 0° | 6 dB |

Figure 6:
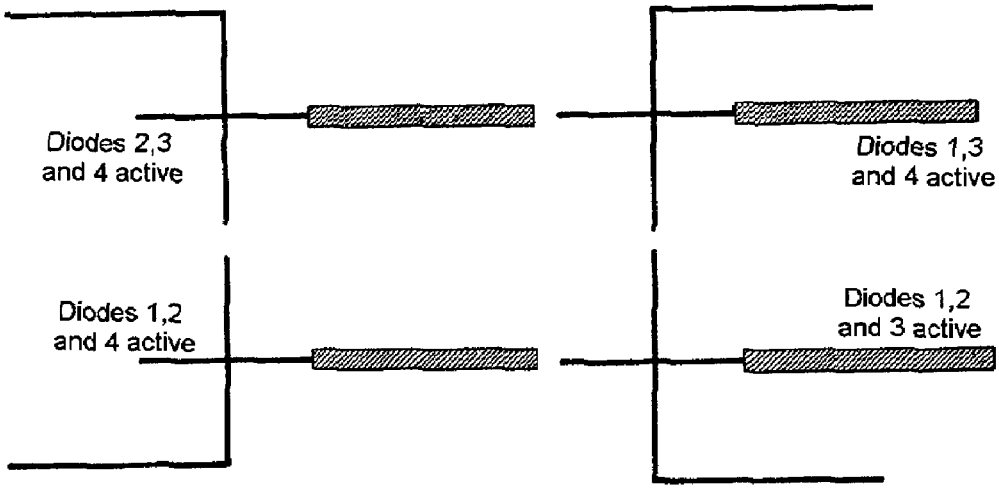
FIG. 6 is a diagrammatic view of the theoretical model of the antenna of FIG. 1 when three diodes are active.

4) FIG. 6 diagrammatically represents the case where three diodes are active. In this case, four modes of operation can be defined. For each of these modes, the radiation pattern possesses a quasi-omnidirectional sectional plane. The relation between the active diodes and the quasi-omnidirectional plane is given in Table 3 below.

TABLE 3

| Active diodes | Plane | Variation in gain in the plane |
|---|---|---|
| 2, 3 and 4 | 60° | 7 dB |
| 1, 3 and 4 | 84° | 7 dB |
| 1, 2 and 4 | 120° | 6 dB |
| 1, 2 and 3 | 94° | 6 dB |

Figure 7:
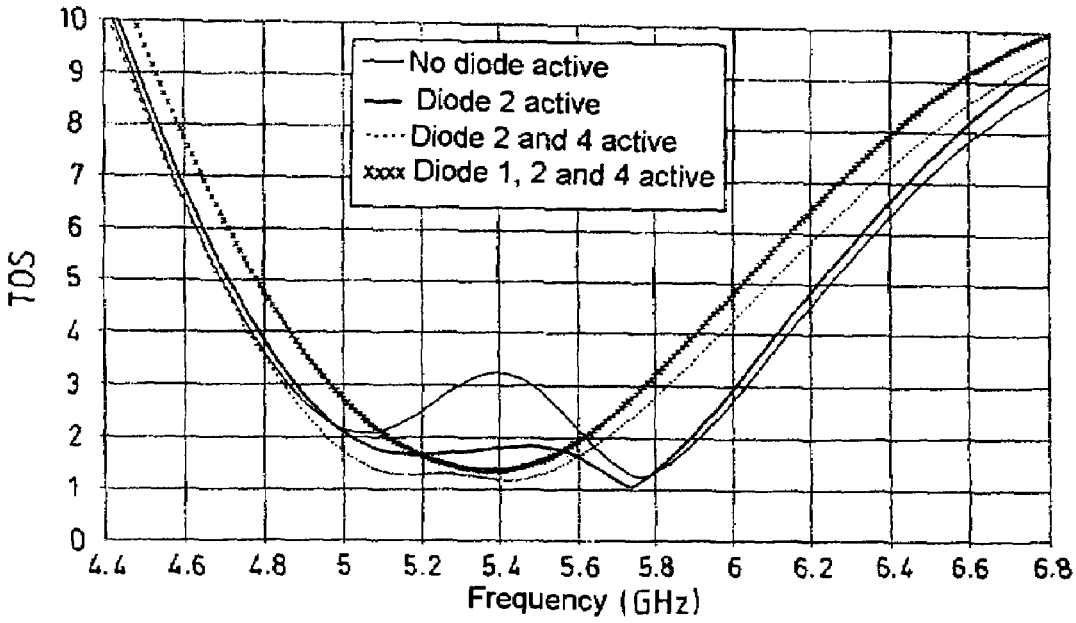
FIG. 7 represents the SWR or standing wave ratio as a function of frequency according to the number of active diodes.

According to FIG. 7 which gives the SWR as a function of frequency, good matching is observed over a sizeable frequency band for the various modes, as a function of the number of active diodes.

By way of indication, the results given above, in particular the patterns, are the results of electromagnetic simulations carried out with the aid of the Ansoft HFSS software on an antenna exhibiting an H structure, such as is represented in FIG. 2, the structure having the following dimensions:

Slots 1, 2, 3, 4, 5: Ls=20.4 mm, Ws=0.4 mm and i=0.6 mm (i representing the width of a metal insert across the slot simulating an active diode).

Feed line 6: Lm=8.25 mm Wm=0.3 mm, L=21.75 mm, W=1.85 mm.

Substrate 10: L=60 mm, W=40 mm. The substrate used is Rogers RO4003 exhibiting the following characteristics: $\epsilon r$=3.38, tangent $\Delta$=0.0022, height H=0.81 mm.

Figure 8:
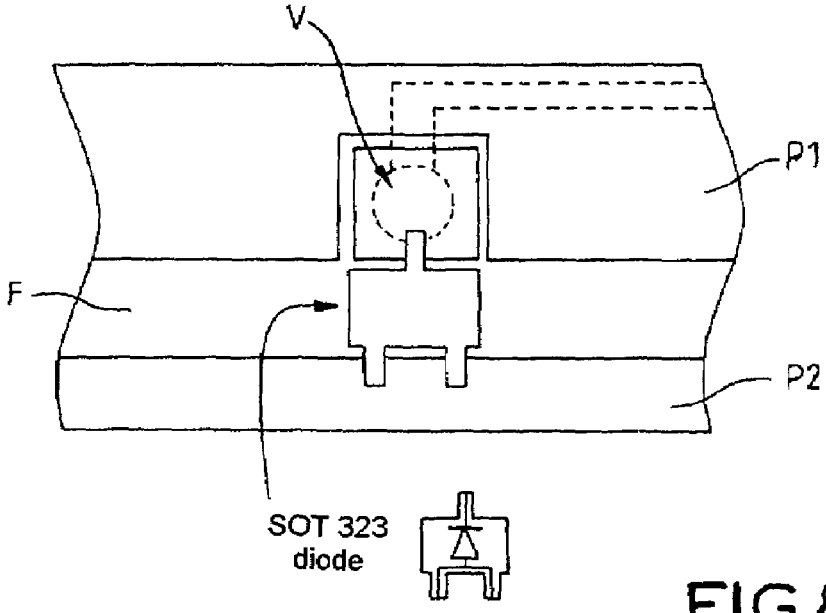
FIG. 8 represents the diagram of the principle of the positioning of a diode in a slot-line.

Moreover, represented diagrammatically in FIG. 8 is the principle of the arranging of a diode in the slot-line, in accordance with the present invention. In this case, the diode used is an HP489B diode in an SOT 323 package. It is placed across the slot-line F in such a way that one of its ends, namely the anode, is connected to the earth plane P2 produced by the metallization of the substrate and the other end, namely the cathode, is connected across a hole V to a control line L produced on the lower face of the substrate, as symbolized by the dashes, the hole V being produced in an element detached from the earth plane P1. The control line L is linked to a supervising circuit (not represented) enabling the diode to be turned on or off. This technique is known to the person skilled in the art and has been described, for example, in the article "A planar VHF Reconfigurable slot antenna" D. Peroulis, K. Sarabandi & LPB. Katechi, IEEE Antennas and Propagation Symposium Digest 2001, Vol. 1 pp 154-157.

The radiation diversity antenna described above exhibits a high diversity of radiation patterns that allows, in particular, its use in systems corresponding to the HIPERLAN2 standard. This antenna has the advantage of being easy to produce using a printed structure on a multilayer substrate. Moreover, the switching system is easy to implement. It can consists of a diode, as represented in the embodiment above but also of any other switching system such as diode-arranged transistors or MEMS ("Micro Electro Mechanical Systems").

Figure 9:
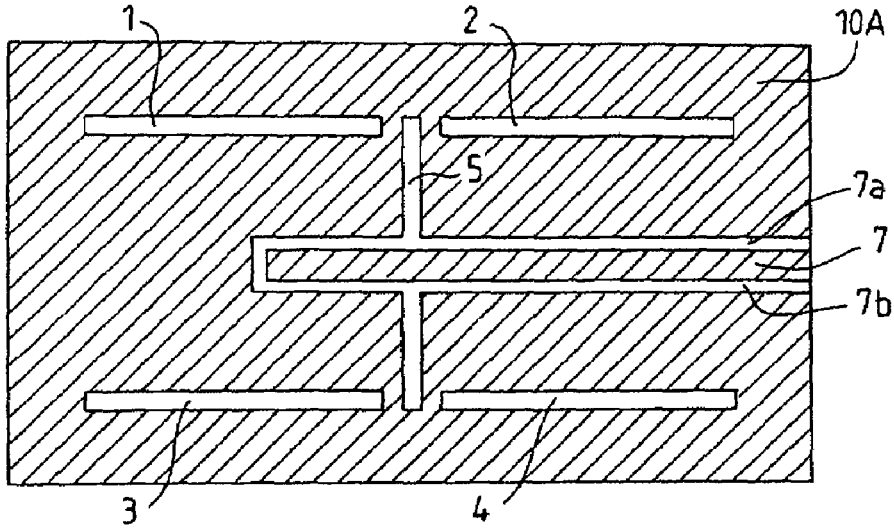
FIG. 9 is a diagrammatic plan view from above of a radiation diversity antenna produced in coplanar mode.

Represented in FIG. 9 is a structure similar to that of FIGS. 1 and 2 but produced by coplanar technology. In this case, the feed line is produced on the same face of the substrate as the earth, as symbolized by the element 7 surrounded by etchings 7*a*, 7*b* which cut the slot-line 5 perpendicularly in its middle. The other elements of the radiation diversity antenna, namely the arms 1, 2, 3, 4 produced by etching the earth plane A, so as to form the slot-lines, are identical to those of FIG. 2. The various dimensions remain identical to those of a structure produced by microstrip technology.

The structure represented in FIG. 9 is particularly attractive for circuits requiring transference of components.

Figure 10:
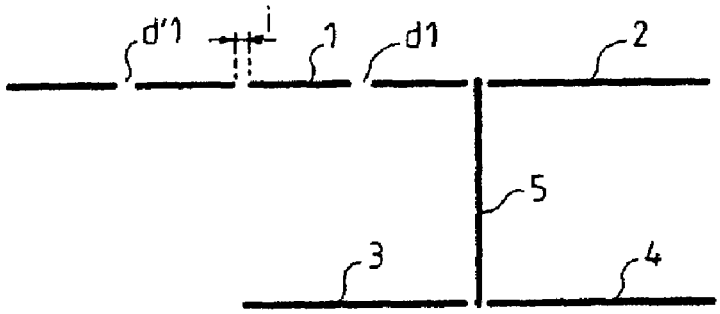
FIG. 10 is a diagrammatic view from above of an antenna in accordance with the present invention according to another embodiment.

Another embodiment of the present invention will now be described with references to FIGS. 10 and 11. In FIG. 10, one of the arms or slot-line 1' of the radiation diversity antenna exhibiting an H structure has a length $\lambda$s while the other arms 2, 3, 4, 5 have lengths $\lambda$s/2. In this embodiment, an insert i is envisaged in the slot-line 1 at a length $\lambda$s/2 and two diodes d1, d'1 are envisaged respectively at distances $\lambda$s/4 and 3$\lambda$s/4 from the start of the slot-line. Operation of the slot-line 1 is disabled when the diode d1 is active. In this case, when only the diode d'1 is active, only the second part of the slot-line 1 does not operate. We thus get back to the operation of an H structure with slot-lines of length $\lambda$s/2.

Therefore, the present invention can be produced with structures exhibiting arms of slot-line type having lengths which may, if they are a multiple of $\lambda$s/2, be identical or different for each arm.

Figure 11:
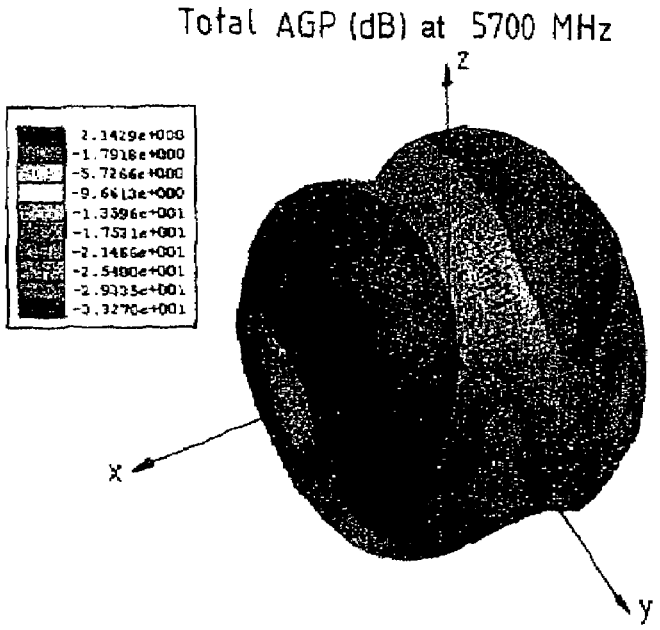
FIG. 11 is a three-dimensional view of the radiation pattern of the antenna of FIG. 10, and FIGS. 12 and 12*a* are respectively a diagrammatic view from above of another embodiment of a radiation diversity antenna according to the present invention and of its three-dimensional radiation pattern.

Represented in FIG. 11 is a 3D radiation pattern obtained by simulation with the aid of the Ansoft HFSS software for an antenna exhibiting a structure of the type of that represented in FIG. 10 but in which all the arms 1, 2, 3, 4 have a length $\lambda$s, the diodes in this case being passive.

Moreover, the use of slot-lines having different lengths makes it possible to obtain frequency diversity in addition to radiation diversity. Specifically, the length of a slot-line conditions its resonant frequency. A slot-line is dimensioned so that its length L is such that L=$\lambda$s/2 where $\lambda$s is the guided wavelength in the slot. Moreover, the resonant frequency f being related to the guided wavelength, $$f = \frac{c}{\lambda s},$$

if the dimension L is modified, then the frequency is also modified.

Figure 12:
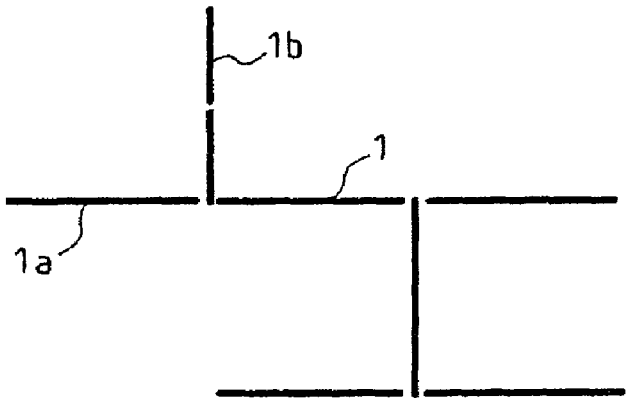

Yet another type of structure that can be used to obtain a radiation diversity antenna in accordance with the present invention will now be described with reference to FIG. 12.

Figure 12A:
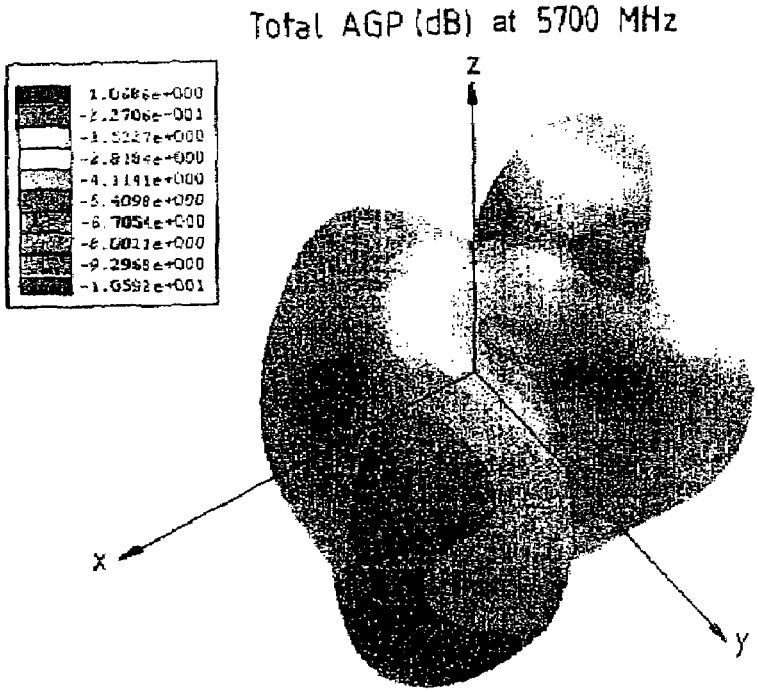

In this case, the arm 1 is extended by two radiating elements 1*a*, 1*b* in such a way as to have a substantially Y structure. In the embodiment of FIG. 12, the two radiating arms 1*a* and 1*b* are perpendicular, thereby giving the radiation pattern of FIG. 12*a*. However, the angle between the arms 1*a* and 1*b* may have other values while still giving the sought-after result. In FIG. 12, a slot-line 1*b* and a slot-line 1*a* have been added on the slot-line 1 so as to enlarge the tree. These two new slot-lines are coupled to the slot-line 1 in such a way that the slot-lines 2 and 3 are coupled to the slot-line 4. By analogy with what was seen earlier, the slot-line 1 is coupled to the slot-lines 1*a* and/or 1*b* as a function of the state of the switching elements placed in these slot-lines 1*a* and 1*b*. This type of tree can also be envisaged on the slot-lines 2, 3 and 4, as well as on the added slot-lines, so as to arrive at a complex tree structure. Thus, the number of accessible configurations is increased as is, consequently, the order of diversity that the structure can provide. For a structure with N slot-lines (each of these slot-lines being furnished with a switching means), the order of diversity is $2^N$.

What is claimed is:

1. A radiation diversity antenna structure comprising:

a substrate having a first side and a second side, a conductive layer disposed on said first side, a radiating element etched into said conductive layer, said radiating element comprising a first arm formed of a radiating slot-line and at least one second arm formed of a radiating slot-line, said second arm extending said first arm in a tree structure, a feed line coupled to the middle of said first arm and a switching means positioned in the at least one second arm to control the coupling of the first and second arms with the feed line.

2. The antenna of claim 1, furthermore comprising at least two second arms and at least two switching means wherein each of the at least two second arms comprises a respective one of the at least two switching means.

3. The antenna of claim 1, wherein the switching means is positioned in an open-circuit zone of the radiating slot-line forming said at least one second arm.

4. The antenna of claim 2, wherein the first arm has a length ecual to $k\lambda s/2$ and the at least one second arm has a length equal to $k'\lambda s/2$, k and k' being an integer equal or different and $\lambda s$ the guided wavelength in the slot-line.

5. The antenna of claim 1, wherein the at least one second arm has a length delimited by an insert positioned in a short-circuit plane of the slot-line forming said at least one second arm.

6. The antenna of claim 5, wherein the insert is positioned at the level of junctions between said first and at least one second arms.

7. The antenna of claim 1, wherein the radiating element comprises a first arm and 4 second arms forming an H pattern.

8. The antenna of claim 7, wherein at least one of said 4 second arm is extended by two additional arms in an Y pattern.

* * * * *